US006345103B1

(12) United States Patent
Cipolla et al.

(10) Patent No.: US 6,345,103 B1
(45) Date of Patent: Feb. 5, 2002

(54) VISOR MOUNTING OF MICROPHONE FOR VEHICLE OPERATOR

(75) Inventors: Thomas Mario Cipolla, Katona, NY (US); Stephane Herman Maes, Danbury, CT (US); Paul Andrew Moskowitz, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/239,357

(22) Filed: Jan. 28, 1999

(51) Int. Cl.[7] ..... H04R 11/04
(52) U.S. Cl. ..... 381/365; 381/361; 381/86
(58) Field of Search ..... 381/86, 361, 362, 381/365, 91; 455/90, 99, 345

(56) References Cited

U.S. PATENT DOCUMENTS 4,056,696 A * 11/1977 Meyerle et al. ..... 179/100 R
4,126,827 A 11/1978 Negrini ..... 325/16
4,169,218 A * 9/1979 Tyler ..... 179/100 R
4,215,250 A 7/1980 Resener ..... 179/149
4,362,907 A * 12/1982 Polacsek ..... 179/1 VE
4,706,273 A * 11/1987 Spear et al. ..... 379/58
4,811,405 A 3/1989 Peimer ..... 381/169
4,905,270 A * 2/1990 Ono ..... 379/58
4,991,220 A 2/1991 Wolf ..... 381/169
D315,890 S 4/1991 Lewo ..... D12/191
5,263,199 A * 11/1993 Barnes et al. ..... 455/344
5,442,813 A * 8/1995 Walters ..... 455/89
5,810,420 A * 9/1998 Welling ..... 296/97.5
6,067,521 A * 5/2000 Ishii et al. ..... 704/275

* cited by examiner

*Primary Examiner*—Sinh Tran
(74) *Attorney, Agent, or Firm*—Stephen C. Kaufman

(57) ABSTRACT

A structural means is provided that positions an operator's voice communication microphone in a vehicle in the vicinity of the visor without interfering with the movement and functions of the visor. The positioning being achieved by attaching a portion of a microphone holder in connection with an escutcheon- type plate that is part of the visor retention and the visor support member and attaching the microphone to another portion of the microphone holder so as to extend the microphone to a position above the visor when the visor is in the stored position.

9 Claims, 2 Drawing Sheets

20
19
18
17
12
14
15
16
13

21
24
25
23
26
27

18
22
28
29
30

18
22
21
26
27
25
24
23
8
34
29
30
33
10
10
31
32

18
22
35
8
21
5
1
3
37
36
38

VISOR MOUNTING OF MICROPHONE FOR VEHICLE OPERATOR

FIELD OF THE INVENTION

The invention relates to microphone positioning in a vehicle for voice communication, and in particular to the positioning of a microphone close to the mouth of the operator or driver when in the operator's or driver's seat.

BACKGROUND OF THE INVENTION AND RELATION TO THE PRIOR ART

In the development of the technology of providing a microphone through which a voice communication from the operator or driver of a vehicle is transferred to a processor , it has been found that the positioning of the microphone in the vicinity of a moveable light shielding device known in the art as a sun visor or visor that is located near the top of the windshield through which the operator must look in engaging in operator tasks, has benefits in that, at that location, extraneous noise is shielded and better voice transmission is achieved.

There have been a number of approaches in the art directed toward employing the visor as an supporting member to which a microphone may be attached. In U.S. Pat. No. 4,811,405 the microphone is merely clipped onto the visor. In other U.S. Pat. Nos. 5,442,813, 4,706,273 and Des. 315,890, the microphone is part of a processor located in the visor.

While the vicinity of the visor has benefits as a location to receive operator or driver voice communication, the visor itself is a separate piece of equipment that has specific uses, some of which involve positioning that is incompatible with the operator or driver voice transmission benefits such as the situation that occurs when it becomes necessary to use the visor to block sun light that is coming in the window of the driver's door, which situation would require moving any attached microphone out of the direct line of the driver's voice.

Recent advances in the art of high accuracy speech recognition in voice communication systems have placed additional constraints on microphone placement and aiming in those systems in relation to the location of the mouth of the operator. In such systems it is also of advantage to be able to retrofit the microphone positioning to accommodate voice communication progress into existing vehicles.

A desirable situation would be to be able, with relative ease of installation, to position a microphone in the vicinity of the visor without having the microphone and visor interfere with the performance of each other.

SUMMARY OF THE INVENTION

In the invention a structural means is provided for positioning an operator's or driver's voice communication microphone in a vehicle in the vicinity of the visor without interfering with the movement and functions of that visor.

The positioning of the microphone is achieved with a structural capability; that has a first functional portion that is attached in connection with a retention and stabilizing member for the visor, that in turn is attached through an interface with a support portion of the vehicle that is built into the vehicle and serves as the supporting member to which the visor is moveably attached; and a second functional portion to which the microphone is attached, that extends essentially in the plane of the support portion interface, to a position above the visor when the visor is in the stored position.

BRIEF DESCRIPTION OF THE DRAWINGS

FIGS. 3 and 4 are a schematic illustration of a two-piece embodiment in which each functional portions is in a separate one of two bolt together parts; in which, FIG. 3 is a schematic illustration of an attachment functional portion, and FIG. 4 is a schematic illustration of the microphone support functional portion.

FIGS. 5A and 5B are cross sectional illustrations of alternate mounting constructions of the invention in a standard visor mounting, in which, FIG. 5A is a cross sectional illustration of the mounting of the invention where the attachment functional portion is positioned between an escutcheon-type plate and the support interface, and, FIG. 5B is a cross sectional illustration of the mounting of the invention where the attachment functional portion is attached above the escutcheon-type plate.

DESCRIPTION OF THE INVENTION

The invention involves a structure for positioning a microphone for the operator or driver of a vehicle that is attached employing the mounting equipment of the driver's moveable light blocking device generally referred to in the art as a visor or sun visor and a support member that is built into the vehicle. The positioning structure of the invention extends up and around the location of the driver's visor when the visor is in the stored position, so as to position the microphone proximate to the mouth of the driver and yet be independent of and unaffected by any position that may be selected for the visor. Furthermore, the visor can still be positioned in one move with one hand and with ease of installation in any previously manufactured vehicle.

Figure 1:
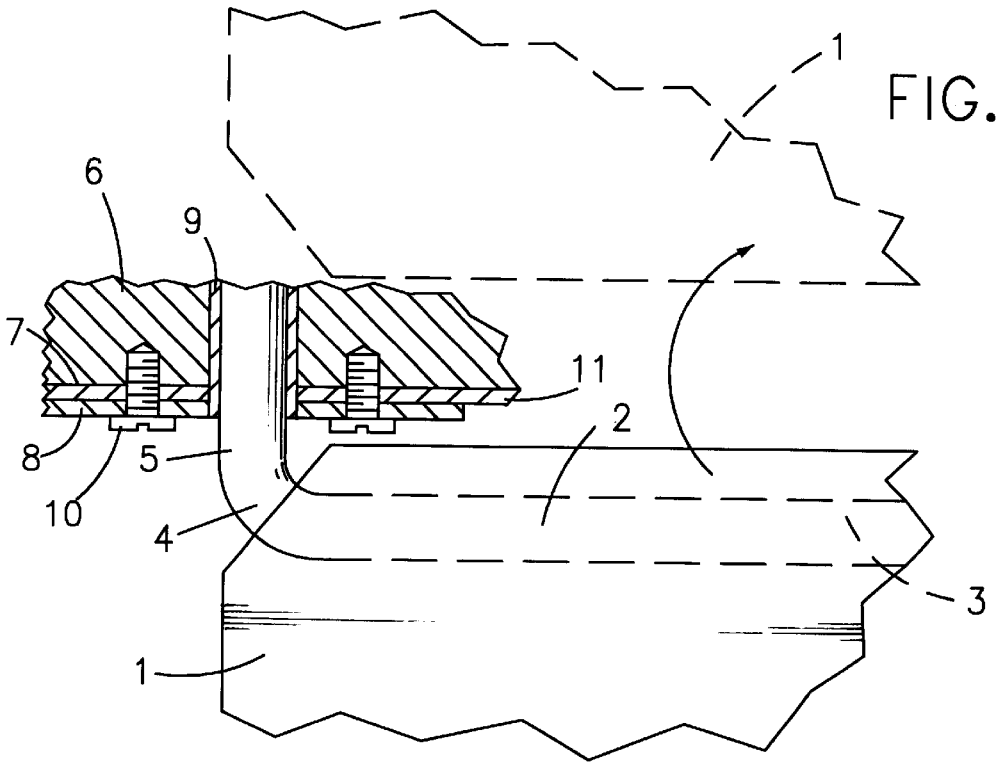
FIG. 1 is a cross sectional perspective view of a standard visor mounting.

Referring to FIG. 1 there is shown a cross sectional perspective view of a standard driver's or operator's sun visor mounting in a vehicle. While there are a number of structural variations employed in the art the variations generally have in common the features illustrated in FIG. 1. The visor 1 is of a material that is generally opaque to light transmission and is mounted so as to be selectively positionable. The visor 1 is rotatable around a longitudinal portion 2 of a rod member 3, shown dotted, that makes an approximately right angle bend 4 at the edge of the visor 1 and the bent portion 5 then enters for retention in a support portion 6 of the vehicle structure. In most constructions the support portion 6 is a solid block attached to the vehicle structure. At an interface 7 with the block 6 an escutcheon-type plate 8 is attached so as to surround and retain, such as by a shoulder 9 the portion 5 of the rod 3, in a rotatable joint. The escutcheon-type plate 8 may be fastened to the support portion 6 by a retention technique such as screws 10 of which two are shown. Where a headliner is used in the vehicle, it is shown as element 11 in the interface 7 between the escutcheon-type plate 8 and the face of the support member 6.

In accordance with the invention a structural means is provided that has a portion that is attached in connection with the visor attachment to the vehicle and extends in an "L" shape up and around the location of the visor 1 when in the stored position, thereby positioning the microphone above the visor and proximate to the mouth of the operator. The visor 1 stored position is just above and essentially parallel to the top of the windshield. It is shown in a dotted area in FIG. 1. The visor 1 is placed in the stored position by rotation around the portion 2 of the rod 3 as indicated by the arc shaped arrow. The attachment function of the microphone positioning applied in connection with the vehicle visor stabilizing mounting is applied in connection with an escutcheon-type plate 8 and further can be achieved in two ways, either by clamping or compressing in the interface 7 between the escutcheon-type plate 8 and the support 6; or placed above the escutcheon type plate 8 and held in place using at least one retention screw 10 through the escutcheon-type plate 8 and into the support 6. The choice of attachment types provides flexibility in the retrofitting of progress in the art into existing vehicles. It will further be apparent to one skilled in the art that the two functional portions of the structural microphone support means could be fabricated as portions of a single piece or be embodied in separate joinable pieces.

Figure 2:
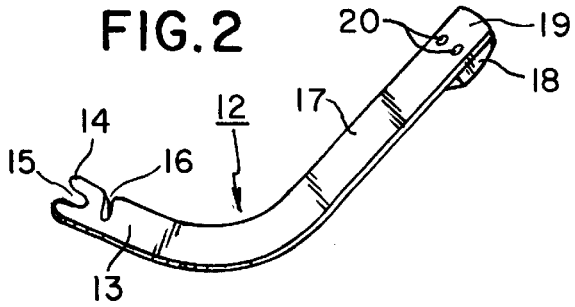
FIG. 2 is a schematic illustration of a single piece embodiment of the invention incorporating both the the microphone positioning and the mounting functional portions.

Considering first the construction in a single piece as illustrated in FIG. 2. Referring to FIG. 2 the two functional portions are embodied in a single element 12 which is an essentially "L" shaped member. The element 12 has a short leg 13, the end 14 of which is adapted for attachment in connection with the escutcheon-type plate 8. The adaption of the end 14 includes a wide slot 15 that will accommodate the diameter of the portion 5 and an arc shaped slot 16 through one of the screws 10 for the escutcheon-type plate 8 passes. Positioning adjustability is provided by the ability to tighten the screw at selected locations in the arc shaped slot 16. The length of the short leg 13 is generally the distance from the visor rod 5 to about the centerline of the communicating person in the vehicle. The element 12 has a long leg 17 at the end of which the microphone 18 for the communication system is positioned usually with direction adjustability 19 shown as positionable screws 20. The length of the long leg 17 is sufficient to position the microphone above the visor 1 when the visor 1 is in the stored position.

There are assembly and microphone directionality adjustment advantages that are gained when the invention is embodied in two joinable pieces.

Figure 3:
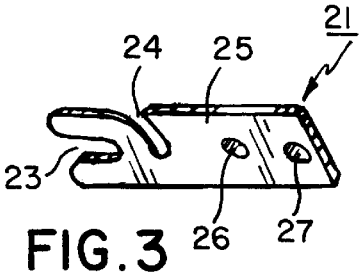
Figure 4:
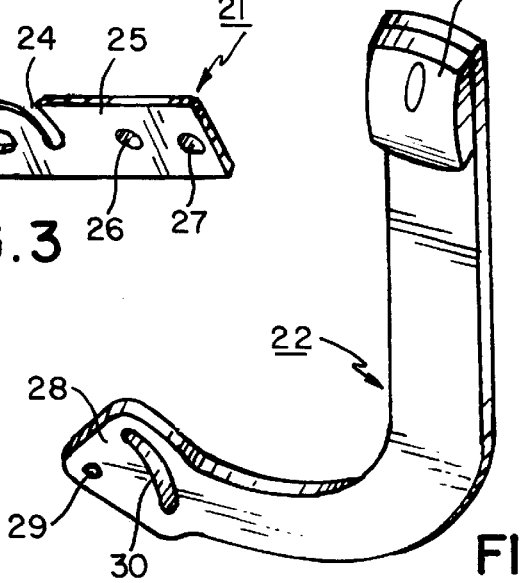

In FIGS. 3 and 4 are shown a two piece embodiment of the invention, employing the same numerals as in the previous figures where appropriate. In FIG. 3, there is shown the first or attachment functional portion labelled element 21 that is to be attached in connection with the escutcheon type plate 8 and the support element 6. In FIG. 3, there is shown the functional portion 22 that positions and supports the microphone 18.

Referring to FIG. 3, the element 21 is a flat or slightly curved member of a material such as metal or plastic that has an attachment capability corresponding to the slots 15 and 16 of FIG. 2; and illustrated as a wide slot 23 that can accommodate the portion 5 of the rod 3 and an arc shaped slot 24 that can accommodate one of the escutcheon-type plate retention screws 10. In an extended portion 25 of the element 21, beyond the portion that will be in contact with the escutcheon type plate 8; screw holes 26 and 27 are provided for screw retention of the microphone support portion 22 as to be described in connection with FIG. 4.

It will be apparent to one skilled in the art that there will be many configurations for element 21 that will perform the function of a firm member that can be attached in connection with escutcheon plate 8 and to which another member 22 can be joined. The advantages of the combination of the slots 15 and 16 of FIGS. 2 and 23 and 24 of FIG. 3 are that the member 12 or 21 can be attached in connection with the escutcheon plate 8 by positioning in the interface 7 or above the escutcheon plate 8; without doing more than loosening or removing one of screws 10 and once the member 12 or 21 is inserted with the portion 5 of the rod 3 in the slot 15 or 23, position adjustment is then available through tightening one of the screws 10 at a selected position along the length of the arc shaped slot 15 or 23.

Referring to FIG. 4 wherein the microphone support member 22 is shown, the member 22 has on one end an attachment portion 28, having a screw hole 29 through which a screw, not shown in this figure, would attach element 21 through hole 26; and having an arc shaped slot 30 through which a screw and washer, also not shown in this figure, would permit moveable attachment to the element 21 through hole 27. The member 22 has the microphone 18 positioned on the remaining end.

There are many types of satisfactory microphones, some of which being highly directional, that are of the same-size range. The wiring, not shown, for the microphone 18, would follow the back or edge of the element 22 and the extended portion 25 of the element 21 to a processor, not shown, elsewhere in the vehicle. The microphone 18 is positioned, when elements 21 and 22 are joined, at the end of the long leg of an "L" shaped member that is sufficiently long that the microphone 18 will extend beyond the edge of the visor 1 when the visor 1 is in the stored position. The element 22 when attached to element 21 would lie in the plane of the interface 7. When desired, the portion of element 22 between the microphone 18 and the bend of the "L" may also be shaped in the direction perpendicular to the microphone 18 such that the microphone does not press too hard on a headliner where one is present and does not interfere with the positioning of the visor 1 when the visor 1 is stored.

Figure 5A:
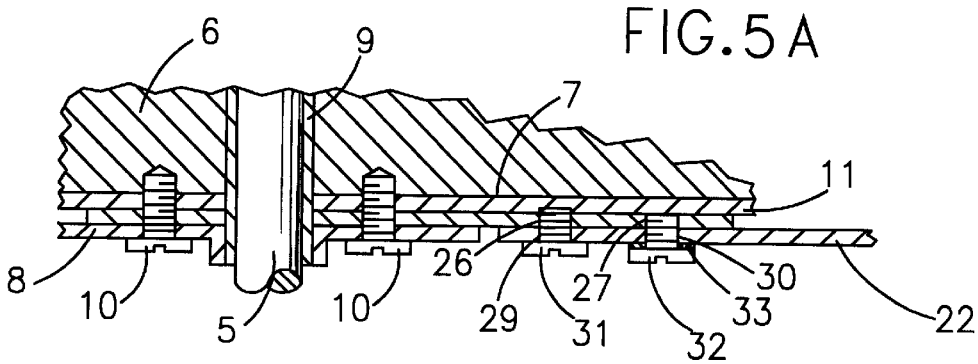
Figure 5B:
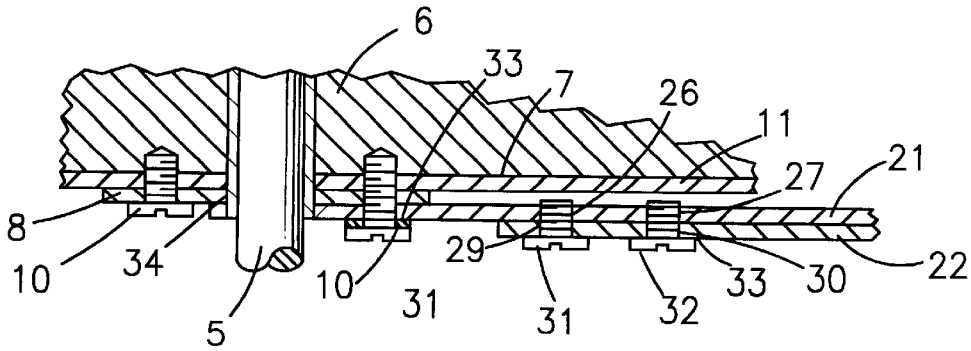

In FIGS. 5A and 5B there are cross sectional illustrations of alternate mounting constructions of the invention that permit mounting flexibility in a standard visor mounting, in which in FIG. 5A there is shown a cross-sectional illustration of the mounting of the invention where the attachment functional portion is positioned under the escutcheon plate 8 at the support interface 7, and, in which in FIG. 5B there is shown a cross sectional illustration of the mounting of the invention where the attachment functional portion is attached above the escutcheon plate.

Referring to FIG. 5A where there is shown a cross sectional view of the visor 1 mounting of the two piece embodiment of the invention using the same reference numerals as in the previous Figures where appropriate. In FIG. 5A the attachment portion of element 21 is positioned at the interface 7 between the escutcheon-type plate 8 and the support member 6 with the portion 5 of the rod 3 extending through the slot 23 and one screw 10 passing through both the escutcheon-type plate 8 and the element 21 at the arc shaped slot 24 and into the support 6. The element 22 is attached to the region 25 of element 21 using screw 31 through hole 29 into hole 26 and screw 32 and washer 33 through arc shaped opening 30 into hole 27.

Referring to FIG. 5B where there is shown a cross sectional view of the visor 1 mounting of the two piece embodiment of the invention using the same reference numerals as in the previous Figures where appropriate. In FIG. 5B the attachment portion of element 21 is positioned over the exposed surface of escutcheon-type plate 8 with the portion 5 of the rod 3 extending through the slot 23 and one screw 10 passing through both the escutcheon-type plate 8 and the element 21 at the arc shaped slot 24 and into the support 6. The element 22 is attached to the region 25 of element 21 using screw 31 through hole 29 into hole 26 and screw 32 and washer 33 through are shaped opening 30 into hole 27.

Figure 6:
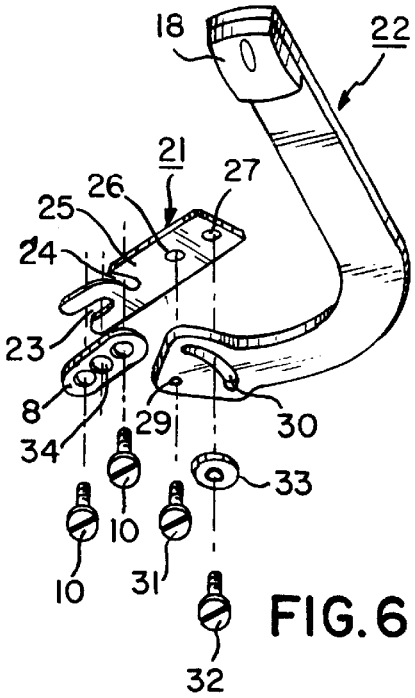
FIG. 6 is an exploded view of the relative positioning of the parts of the two piece embodiment of the invention for assembly in mounting the visor.

Referring to FIG. 6 there is shown the two piece embodiment of the invention in an exploded view showing the relative positioning of the parts, again using the same reference numerals as used in earlier figures where appropriate. In the exploded view of FIG. 6 elements 21 and 22 are attached at the portions 25 and 28 with screw 32 through washer 33 and slot 30 into hole 27; and with screw 31 through hole 29 into hole 26. The attachment provides positioning selectability for the microphone 18 through the travel in the slot 30. The ability to position the microphone 18 achieved through movement capability 19, slot 30 in element 22 and slot 24 in element 21 facilities getting good directionality useful in speech recognition processing. The slot 23 in element 21 aligns with the po rtion 5 of the rod 3, not shown in this Figure, that would extend through the hole 34 of element 8 and through the slot 23.

Figure 7:
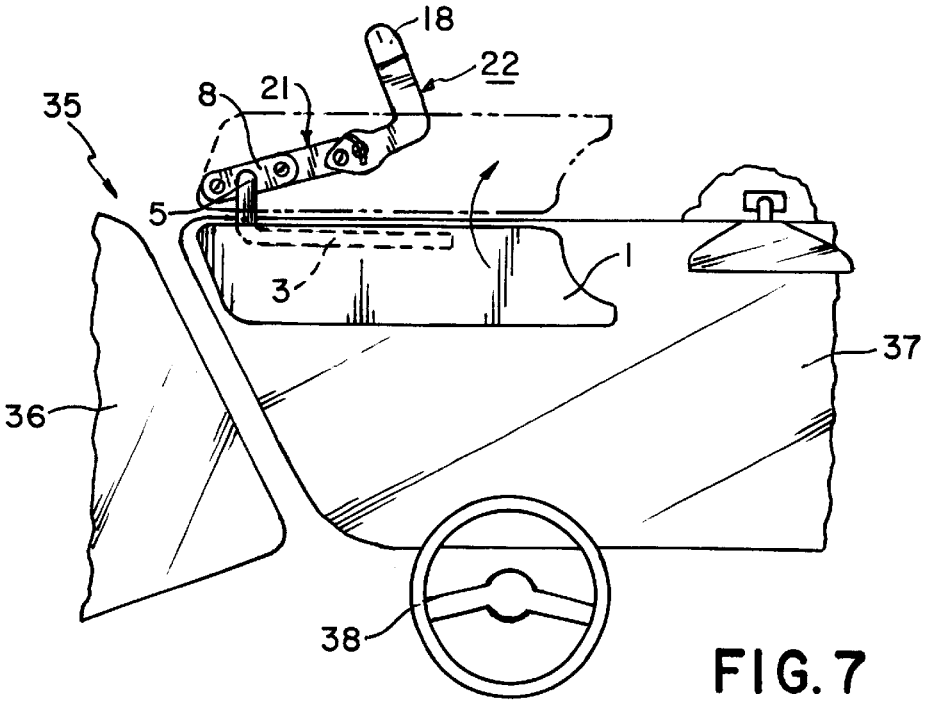
FIG. 7 is a perspective sketch of the two piece embodiment of the invention mounted in a vehicle.

A perspective sketch of the two piece embodiment of the invention when mounted in a vehicle is provided in FIG. 7. Referring to FIG. 7 wherein the same reference numerals as used in previous figures are used where appropriate the vehicle is labelled 35 and the view is of the driver's door window 36 intersection with the windshield 37 above the steering wheel 38. The visor 1 is shown folded down over part of the windshield 37 to make visible the microphone 18 mounting of the invention held in place by the escutcheon-type plate 8 through which the portion 5 of the rod 3, shown dotted, passes. The visor 1 can be rotated as shown with the arc shaped arrow into the storage position shown dotted which position does not interfere with the microphone 10 which extends above.

What has been described is a structural means to position an operator's voice communication microphone in a vehicle in the vicinity of the operator's visor without interfering with the movement and functions of the visor by having one functional portion attached in connection with the retention means of the visor and another functional portion that extends the microphone location to a position above the visor when the visor is in the stored position.

What is claimed is:

1. A mounting device for positioning a voice communication microphone for a vehicle operator in the vicinity of a rod supported, escutcheon-type plate retained, visor, in said vehicles, comprising:

an "L" shaped flat member, having a long leg and a short leg each extending from a bend in said flat member, said "L" shaped flat member having a microphone positioned at the end of said long leg, and, said "L" shaped flat member, at the end of said short leg, having a region that is adapted for attachment in connection with said escutcheon-type plate and a visor support member that is attached to said vehicle.

2. The mounting device of claim 1 wherein said short leg of said "L" shaped member has said region for attachment constructed as a separate piece at the end of said short leg that is attached to the remaining portion of said short leg.

3. The mounting device of claim 2 wherein said separate piece having a first slot and a width to accommodate said visor supporting rod, and a second , arc shaped slot, having a width to accommodate a compressive retention member passing through said escutcheon-type plate into said visor support member that is attached to said vehicle.

4. The mounting device of claim 3 wherein said remaining portion of said short leg, involves a pivot retaining member and a retaining member in a curved slot in the remaining portion of said short leg of said "L" shaped member.

5. The method of mounting an operator's voice communication microphone in the vicinity of an operator's visor of the type where said visor is mounted on a rod with essentially horizontal and vertical rotation capability and where said visor is retained by an escutcheon type plate that is attached to a support portion of said vehicle, comprising the steps of:

providing a flat "L" shaped, with a long and a short leg separated by an "L" shaped bend, a structural support member for said microphone, fabricating on the end of said short leg, a region to be attached in connection with said escutcheon-type plate and said support portion of said vehicle, and, fabricating said long leg with a length extending to a microphone attachment location on the end that positions said microphone beyond any area occupiable by said visor.

6. The method of claim 5 including in the steps of providing a flat "L" shaped, with a long and a short leg separated by an "L" shaped bend, structural support member for said microphone, through fabricating on the end of said short leg, a region to be attached in connection with said escutcheon type plate and said support portion of said vehicle, the additional step of constructing said region as a separate piece at the end of said short leg for attachment to the remaining portion of said short leg.

7. The method of claim 6 including in the step of constructing said region as a separate piece at the end of said short leg, the additional step of adapting said separate piece with a first slot in the end of having a width to accommodate said visor supporting rod, and a second, arc shaped slot, having a width to accommodate a retention member.

8. The method of claim 7 including the additional step of fabricating on the remaining portion of said short leg, a pivot retaining member hole, and a retaining member curved slot in the remaining portion of said short leg of said "L" shaped member.

9. In vehicle visor structure of the type where the visor is mounted on a rod with essentially horizontal and vertical rotation capabilty that in turn has retention to a support portion of the vehicle, the improvement comprising: said retention to a support portion of the vehicle including, an at least partially surrounding escutcheon-type plate, with, said microphone structural support means having first and second portions, said microphone structural support means having a first portion that is a first separate part that is flat with a locating capability that is a visor accommodating slot and an arced retention screw accommodating slot and with extended part attachment in connection with said retention of said visor to said vehicle, and, said microphone structural support means further having a second portion that is a second separate part extending to a microphone attachement location, said microphone attachment location being located beyond any are occupiable by said visor.

* * * * *